United States Patent [19]

Juckniess et al.

[11] 4,116,801

[45] Sep. 26, 1978

[54] APPARATUS FOR ELECTROWINNING MULTIVALENT METALS

[75] Inventors: Paul R. Juckniess; David R. Johnson, both of Midland, Mich.

[73] Assignee: The Dow Chemical Company, Midland, Mich.

[21] Appl. No.: 722,916

[22] Filed: Sep. 13, 1976

Related U.S. Application Data

[63] Continuation-in-part of Ser. No. 517,567, Oct. 24, 1974, abandoned.

[51] Int. Cl.[2] ..... C25C 3/22; C25C 3/28; C25C 7/04

[52] U.S. Cl. ..... 204/247; 204/295; 204/64 T

[58] Field of Search ..... 204/243 R, 247, 295, 204/64 T

[56] References Cited

U.S. PATENT DOCUMENTS

| | | | |
|---|---|---|---|
| 2,789,943 | 4/1957 | Kittleberger | 204/295 X |
| 3,098,802 | 7/1963 | Beer | 204/295 X |
| 3,222,265 | 12/1965 | Beer | 204/295 X |

FOREIGN PATENT DOCUMENTS

| | | | |
|---|---|---|---|
| 678,807 | 9/1952 | United Kingdom | 204/64 T |

*Primary Examiner*—John H. Mack
*Assistant Examiner*—D. R. Valentine
*Attorney, Agent, or Firm*—Robert W. Selby

[57] ABSTRACT

An apparatus to electrolytically produce multivalent metals, such as titanium, from compounds thereof. The apparatus includes a suitable containing body with an anode and a cathode in compartments therein spaced apart by a foraminous metallic diaphragm. The diaphragm has a diaphragm coefficient of greater than zero to about 0.5 when the coefficient of flow is about 0.1 to about 25. A multivalent metal compound feed means is combined with the cathode compartment to supply a multivalent metal compound to a molten salt electrolyte in the cathode compartment. The apparatus is sealed from the atmosphere to avoid contamination of the bath and metal product with certain atmospheric gases. Means of providing sufficient electrical and thermal energy to operate the cell are provided.

76 Claims, 4 Drawing Figures

APPARATUS FOR ELECTROWINNING MULTIVALENT METALS

This application is a continuation-in-part of Ser. No. 517,567, filed Oct. 24, 1974, now abandoned.

BACKGROUND OF THE INVENTION

This invention relates to the production of metals and more in particular to an apparatus to electrolytically form a multivalent metal from a salt thereof.

Metals, such as titanium, have previously been produced from compounds thereof, for example, titanium tetrachloride, by electrolytic means as described in U.S. Pat. Nos. 2,789,943; 2,943,032; and 3,082,159. Generally, the titanium tetrachloride is introduced into a molten alkali or alkaline earth metal salt bath through appropriate means and electrolytically disassociated to plate metallic titanium on a cathode and to release elemental chlorine at an anode. Various means have been employed to separate the anode from the cathode in the titanium-bearing electrolytic cells.

A physical barrier, such as a diaphragm, positioned between the anode and cathode compartments is necessary to prevent an excessive flow of titanium ions from the cathode compartment into the anode compartment. If such an excessive ion flow occurs, titanium ions would be oxidized to titanium tetrachloride thereby reducing the cell efficiency. The diaphragm should also permit passage of chloride ions and a fused salt bath between the anode and the cathode compartments.

The diaphragm of U.S. Pat. No. 2,789,943 consisted of a perforate, electrically conductive metallic structure which, when in use, was interchangeably an anode or a cathode. The diaphragm was made a cathode to cause deposition of metallic titanium into the pores thereof and reduce the porosity of the diaphragm. The electrical polarity was reversed, making the diaphragm an anode to remove titanium therefrom, when the diaphragm became excessively impervious and reduced the electrolytic cell efficiency. Such a diaphragm of variable porosity is operable; however, it would be more desirable to have a diaphragm which would not necessitate constant monitoring and frequent metal plating thereon and etching therefrom.

Leone et al., Use of Composite Diaphragms in Electrowinning of Titanium, Bureau of Mines Report RI 7648 (1972) and Leone et al., High-Purity Titanium Electrowon from Titanium Tetrachloride, J. of Metals 18 (March 1967) describe porous, metal screen-ceramic composite diaphragms positioned between anodes and cathodes for use in the electrowinning of titanium. The metal screen-ceramic composite is more costly and has a lower strength than is desired for production operations.

The electrolytic cells of the prior art are operable; however, the barrier or diaphragm between the anode and cathode chambers has usually been deficient in strength characteristics needed for production-type electrolytic equipment or required continuous and careful regulation of the porosity during operation of the cell. An improved electrolytic cell for the electrowinning of metals using a diaphragm with adequate physical properties and a constant porosity, which need not be regulated during operation, is desired.

SUMMARY OF THE INVENTION

The novel electrolytic cell of this invention comprises, in combination, a body adapted to contain a fused salt bath and no separate the bath from the ambient atmosphere. An anode compartment and a deposition cathode compartment are suitably positioned within the body in a spaced apart relationship to each other. The anode and cathode compartments are spaced apart by at least one foraminous metallic diaphragm adapted to be electrically insulated from sources of electrical energy exterior to the anode and cathode compartments and at least partially immersed within the fused salt bath during operation of the cell. The diaphragm is characterized by a diaphragm coefficient ($C_d$) within the range of from greater than zero up to about 0.5 when the coefficient of flow ($C_f$) is within the range of from about 0.1 to about 25. Herein $C_d$ is defined as being in inches and $C_f$ as being in $\sqrt{\text{inches}}$ per liter per minute per 30 square inches of diaphragm surface. The diaphragm coefficient can be determined by the hereinafter described procedure and is represented by the formula:

$$C_d = \frac{\frac{V_{d+s}}{I_{d+s}} - \frac{V_s}{I_s}}{\frac{V_s}{I_s}} \times 0.75$$

wherein:

"$V_{d+s}$" is the voltage (volts) in an aqueous 0.1 molar sodium chloride solution of a test cells as determined by calomel measuring electrodes communicating with the solution in the test cell by salt bridges with with orifices to such salt bridges spaced 0.75 inch apart between silver-silver chloride primary electrodes, spaced one inch apart, and also spaced apart by the portion of the diaphragm positioned between the primary electrodes during operation "$I_{d+s}$" is an electrical current of 0.002 amperes maintained between the primary electrodes in the solution with a diaphragm positioned as for $V_{d+s}$ "$V_s$" is the voltage (volts) as determined for $V_{d+s}$, but without the diaphragm "$I_s$" is an electrical current of 0.002 amperes maintained between the primary electrodes in the solution as determined for $I_{d+s}$, but without the diaphragm The coefficient of flow is represented by the formula:

$$C_f = \frac{\sqrt{h}}{F}$$

where:

"$h$" is a pressure head of ten inches of water at about 75° F. as measured upwardly from the centerline of a circular diaphragm portion, with a 30 square inch area on a single surface of such diaphragm portion, where a water flow measurement through the diaphragm is obtained, and "F" is the volumetric water flow rate through the diaphragm portion in liters per minute at about 75° F.

The diaphragm configuration or size may necessitate that a diaphragm portion smaller or larger than the above 30 square inch portion be used for measuring the water flow. When such a smaller or larger diaphragm portion is used, F should be calculated to represent the water flow through the 30 square inch area described above.

Stated in a slightly different manner, the above formula for determining the diaphragm coefficient is believed to be basically the combined resistance of the diaphragm plus the solution in the test cell minus the resistance of the solution divided by the resistance of the solution. The number resulting from this calculation represents the electrical resistance of the diaphragm in terms of the electrical resistance of 0.75 inch of solution, since the salt bridges are spaced 0.75 inch apart. To convert the calculated number to a term expressed in inches of solution, the calculated number is multiplied by 0.75. The diaphragm coefficient represents the electrical resistance of the diaphragm in the test cell. The diaphragm coefficient is also believed to be a measure of the resistance of the solution contained in the pores of the diaphragm.

The electrolytic cell of the present invention further includes at least one anode, adapted to be at least partially immersed in the bath, positioned within the anode compartment. At least one deposition cathode adapted to be at least partially immersed in the bath is simultaneously positioned within the cathode compartment. A suitable means to remove gases formed at the anode is combined with the anode compartment. At least one feed means adapted to provide a metal containing feed material, such as an ionizable metal compound, to the bath and a suitable means to remove metal deposited at the cathode are combined with the cathode compartment. Additionally, a means adapted to provide sufficient electrical energy to the anode and the deposition cathode to reduce the metal ions from a higher to a lower valence state and to deposit the metal at the deposition cathode is suitably connected to the anode and the cathode.

The herein described electrolytic cell is suitable for the production of titanium and other multivalent metals in a fused halide bath. Multivalent metals are characterized by having at least two possible valence levels when ionized. Exemplary of such metals are V, Cr, Mn, Fe, Co, Ni, Y, Zr, Nb, Mo, Ru, Rh, Pd, Te, Os, Ir and Pt.

DESCRIPTION OF THE DRAWING

The accompanying drawing further illustrates the invention.

Identical numerals, distinguished by a letter suffix, within the several figures represent parts having a similar function within the different embodiments.

DESCRIPTION OF THE PREFERRED EMBODIMENTS

Figure 1:
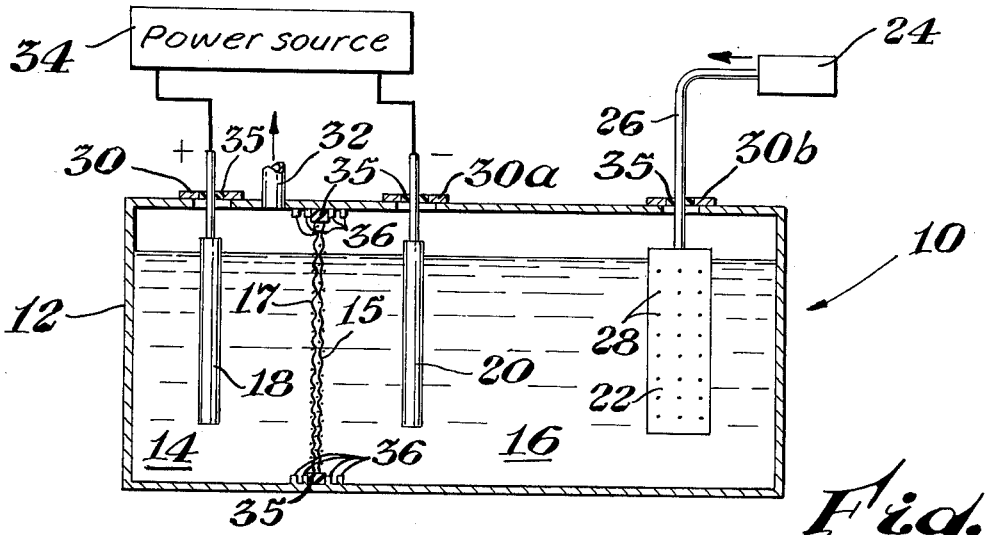
FIG. 1 is a cross-sectional view of an electrolytic cell for the production of a solid multivalent metal.

In FIG. 1 is depicted electrolytic equipment 10 suited to electrowin multivalent metals, preferably titanium, in a fused salt bath from compounds thereof. The hereinafter description refers to a preferred apparatus to electrowin titanium; however; such description also applies to the mulitvalent metal, generally.

The fused or molten salt is characterized as being a solvent for the titanium compound. Such salts or mixtures thereof can be, for example, NaCl, LiCl—KCl, LiCl—KCl—NaCl, and LiCl—KCl—$CaCl_2$. When titanium is recovered from titanium tetrachloride, the fused bath desirably contains a mixture of alkali or alkaline earth metal halides, preferably lithium and potassium chlorides. A eutectic mixture of the salts employed in the bath is advantageous because of the low melting temperature of such mixture.

The electrolytic equipment 10 includes a body or containing means 12 adapted to hold or contain the fused halide salt bath and titanium tetrachloride without substantial adverse effects to the material of which the containing means 12 is constructed. Although a number of different materials are suitable, the containing means 12 is generally formed of a metal, such as steel, nickel and the like. The containing means 12 is internally divided into at least an anode compartment 14 and a deposition cathode compartment 16. The anode compartment 14 and the cathode compartment 16 are spaced apart from each other by a porous metal diaphragm 17. A diaphragm support 15 can optionally be combined with the diaphragm 17 to complement the diaphragm strength during operation of the equipment 10.

The diaphragm substrate is preferably a metal screen, sheet or film with a multiplicity of holes or pores extending therethrough. Such pores can be formed by, for example, drilling, punching, weaving, sintering and the like. Generally, and preferably, the holes in the substrate are of a substantially uniform size. The diaphragm 17 preferably is a woven wire screen having a U.S. Standard Screen Mesh of about 50 to about 250 and more preferably about 100 to about 200 on which sufficient nickel or cobalt has been deposited by electrolytic or electroless procedures to provide a desired diaphragm coefficient ($C_d$) and flow coefficient ($C_f$). Preferably the deposited metal consists essentially of either cobalt or nickel. Suitable deposition procedure are those well known in the art adapted to produce a visually dull or rough surface by, for example, using a reduced amount of brighteners in the plating solutions. Table I is illustrative of electroless cobalt and nickel plating solutions suitable for use in plating the diaphragm 17.

The diaphragm substrate can be, for example, iron such as steel or stainless steel, but it is desirably a metal, such as cobalt, nickel or an alloy thereof containing at least about 50 weight percent cobalt or nickel, which is resistant to the corrosive environment within the containing means 10 and retains sufficient strength at predetermined operating temperatures to act as a diaphragm. More preferably the diaphragm substrate is commercially pure nickel.

Table I

| Plating Compositions | |
|---|---|
| Electroless Nickel | Grams per liter of final Solution |
| basic nickel carbonate-$4NiCO_3 . 3Ni(OH)_2 . 4H_2O$ | 10.0 |
| Citric acid - $C_6H_8O_7$ | 5.25 |
| Ammonium bifluoride - $NH_4HF_2$ | 10.0 |

Table I-continued

| Plating Compositions | |
|---|---|
| Electroless Nickel | Grams per liter of final Solution |
| Sodium hypophosphite - $NaH_2PO_2 . H_2O$ | 20.0 |
| Hydrofluoric acid 70% volume HF Solution | 6.0 milliters/liter |
| Ammonium hydroxide 30% volume $NH_4OH$ | 30.0 milliters/liter |
| pH - about 6.5 | |
| Electroless Cobalt | |
| Cobalt chloride - $CoCl_2 . 6H_2O$ | 30.0 |
| Sodium citrate - $Na_3C_6H_5O_7 . 2H_2O$ | 35 to 50 |
| Ammonium chloride - $NH_4Cl$ | 50 |
| Sodium hypophosphite - $NaH_2PO_2 . H_2O$ | 20 |
| pH - 8 to 9 | |

An anode 18 is disposed in the anode compartment 14 and adapted to be at least partially immersed in the molten halide bath during operation of the electrolytic equipment 10. The material of which the anode 18 is formed is resistant to the corrosive effects of the fused halide bath and also to the elemental chlorine formed at the positive charged anode during operation of the cell. Suitable anode materials are, for example, carbon and graphite. A cathode 20 is suitably disposed within the cathode compartment 16 to be at least partially immersed in the fused halide bath during operation of the electrolytic equipment 10. The deposition cathode 20 is a material such as carbon or a metal as plain carbon steel, titanium and the like onto which metallic titanium can be deposited or plated and subsequently recovered.

The cathode chamber 16 also includes a means (not shown) suitable to heat and to maintain the contents of the equipment 10 at a desired temperature, by heating or cooling, and a feed means 22 adapted to provide a titanium containing feed material to the fused halide bath during operation of the equipment 10. In operation, titanium tetrachloride is passed from a source means 24 through a conduit 26 into the feed means 22 where the titanium tetrachloride passes through a plurality of openings or holes 28, defined by the feed means 22, into the molten halide bath in the cathode compartment 16.

The containing means 12 is fitted with closures 30, **30*a* and 30*b* to provide access to the anode 18, the cathode 20 and the feed means 22. The closures 30, 30*a* and 30*b* are preferably suitably removably attached to the containing means 12 to afford employment of a controlled atmosphere within the containing means 12 and prevent a sufficient amount of the ambient atmosphere, especially nitrogen, oxygen, carbon dioxide and water vapor, from entering into the containing means 12 during operation to substantially reduce the efficiency of the process. Preferably the closures 30, 30*a* and 30*b* substantially entirely exclude oxygen from the compartments 14 and 16. The closure 30*a* is also adapted to provide a means to remove the metallic titanium from the cathode compartment 16 after solid, elemental titanium has been plated onto the deposition cathode 20**.

Gaseous chlorine formed at the anode 18 flows to a condenser or chlorine container (not shown) from the anode compartment 14 through a chlorine removal means or pipe 32.

An electrical supply means, such as a generator or rectifier 34, is adapted to provide sufficient electrical energy to the equipment 10 to reduce titanium ions with a valence of +4 to a lower valence state, deposit metallic titanium onto the negative charged deposition cathode 20 and to release elemental chlorine at the positive charged anode 18. The anode 18, deposition cathode 20, feed means 22 and the diaphragm 17 are electrically insulated by insulators 35 from the containing means 12. Furthermore, the diaphragm 17 is electrically insulated from electric sources outside of the anode compartment 14 and the cathode conpartment 16, such as, the electrical circuitry connected to the anode 18 and the cathode 20. In other words, the diaphragm 17 is positioned in the containing means 12 and operates in the equipment 10 without being electrically wired to impart an electric charge on the diaphragm.

The containing means 12 optionally includes a diaphragm positioning means, such as flanges 36 suitably spaced apart to form passageways or receptacles, into which the diaphragm 17 can be removably positioned. Should it become necessary to replace the diaphragm 17 during operation of the embodiment of FIG. 1, a second diaphragm (not shown) can be juxtaposed to the diaphragm 17 in the unused flanges 36 prior to removal of the diaphragm 17. Optionally, through the use of the flanges 36, more than one diaphragm can simultaneously be employed. Alternatively, the flanges 36 can be used to retain at least one filter means (not shown) in at least the cathode compartment 16 and optionally, the anode compartment 14 to prevent mechanical damage to or physical plugging of the diaphragm 17 with solid matter contained in the catholyte or anolyte.

Figure 2:
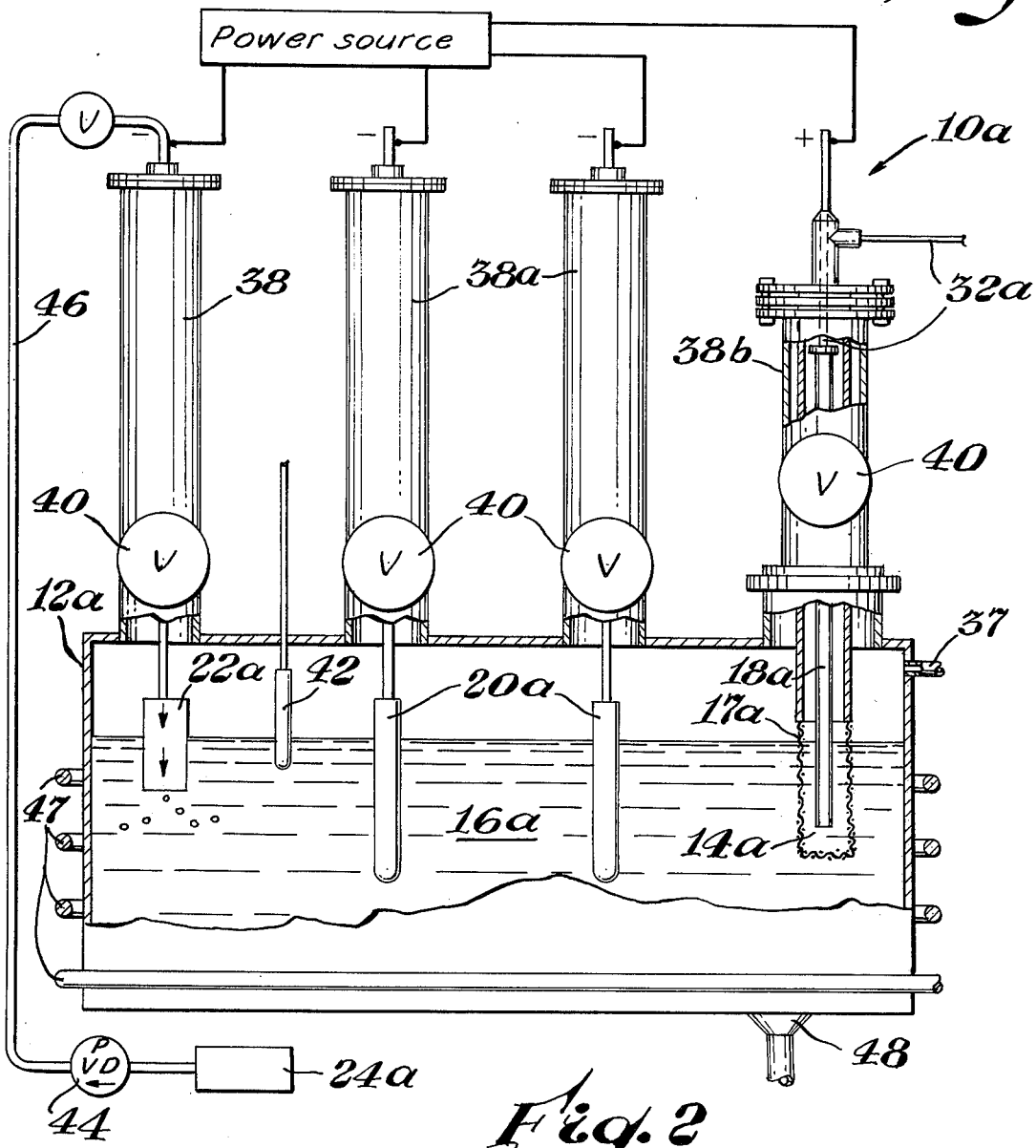
FIG. 2 is a cross-sectional view of another embodiment of the invention.

FIG. 2 is illustrative of a preferred embodiment of an electrolytic cell assembly **10*a* wherein an externally heated and/or cooled containing means 12*a* is adapted to hold a potassium chloride-lithium chloride-titanium di-chloride-titanium tri-chloride containing catholyte in a cathode compartment 16*a* and a lithium chloride-potassium chloride electrolyte in an anode compartment 14*a*. The anode compartment 14*a* is spaced apart from the cathode compartment 16*a* by a porous woven screen diaphragm 17*a* surroundingly positioned in a spaced apart relationship around an anode 18*a*. To prolong the useful life of the diaphragm, the distance between the diaphragm and anode is preferably selected to be at least ¼ times, and more preferably within the range of from about ¼ to about 1½ times, and even more preferably substantially, equal to the anode diameter. Two deposition cathodes 20*a* and a titanium ion feed means or feed cathode 22*a* are disposed in the cathode compartment 16*a* in a spaced apart relationship to each other and to the diaphragm 17*a*. The containing means 12*a* is also electrically insulated from the diaphragm 17*a* and the various electrically charged components of the assembly 10*a***.

Examples of suitable feed means **22*a*** are described in more detail in a copending U.S. patent application, filed September 13, 1976 by David R. Johnson bearing Ser. No. 722,851, which is incorporated herein by reference.

The containing means **12*a* is preferably adapted to be substantially gas tight to prevent entrance of atmospheric gases into the anode compartment 14*a* and/or the cathode compartment 16*a*. To facilitate operating the cell assembly 10*a* in a controlled, substantially inert atmosphere, a protective gas inlet means 37 is provided to permit entrance of a protective gas into the enclosed containing means 12***a*. For titanium, the controlled atmosphere is a gas, such as argon or helium, which is substantially inert to the electrolyte and the titanium at the normal operating temperatures. When a lithium chloride-potassium chloride electrolyte is used in combination with titanium tetrachloride, the operating temperature is generally within the range of from the eutectic temperature of the salt mixture (about 348° C.) to about 650° C. and preferably from about 475° to about 575° C. Naturally, the operating temperature will vary according to the melting point, or range, of the specific electrolyte employed.

To afford removal of the anode 18*a*, the deposition cathodes 20*a* and the feed cathode 22*a* for, for example, replacement or examination, it is preferred that gas tight chambers, such as air locks s38, 38*a* and 38*b*, be provided to permit removal of such cathodes and/or anode without substantial contamination of the atmosphere within the anode compartment 14*a* or the cathode compartment 16*a* with reactive atmospheric gases. A means, such as valves 40, suited to seal the anode compartment 14*a* and the cathode compartment 16*a* from the atmosphere exterior thereto are provided to prevent reactive gases from entering into the containing means 12*a* and contaminating the atmosphere therein. The valves 40 are adapted to slidably close and seal the air locks 38, 38*a* and 38*b* when the anode, cathodes or diaphragm are removed from or inserted into the containing means 12*a*. Operation of such valves and air locks are known to those skilled in the art.

A means 32*a* to remove the gaseous chlorine produced is at least partially disposed within the anode air lock 38*b*. Deposition cathode air locks 38*a* can be employed to remove metallic titanium from the cathode compartment 16*a*.

A valence electrode 42 is adapted to be at least partially immersed in the fused halide electrolyte to determine the average valence of the titanium ions within such electrolyte during operation of the cell assembly 10*a*. The valence electrode 42 can be adapted to be connected with a titanium tetrachloride supply source 24*a* and a titanium tetrachloride metering means, such as pump 44, to control or regulate the titanium ion concentration, and thus the average titanium ion valence, within the cathode compartment 16*a*. The metering pump 44 is adapted to regulatively supply titanium tetrachloride to the feed cathode 22*a* through conduit or pipe 46 to thereby control the titanium ion concentration at a predetermined level.

Preferably an electrolyte temperature controlling means 47 is provided to maintain the electrolyte within the anode and cathode compartments 14*a* and 16*a* at predetermined desired temperatures. The temperature controlling means 47 can either regulatively cool or heat the electrolyte, as required, by selected well known means, such as air, electricity, gas, oil and the like.

During operation of the cell assembly 10*a*, undesirable oxides, nitrides and other solid matter, such as the waste material generally known in the art as sludge, may accumulate within the containing means 12*a*. A sludge removal means, such as a conduit and valve assembly 48, can be provided to permit either manual or merchanized removal of the sludge without excessive loss of the electrolyte from the cell assembly 10*a*.

The configuration of the diaphragm 17*a* is of prime importance in the described apparatus. It is necessary that the pores or openings in the diaphragm 17*a* be large enough to avoid being plugged with, for example, a substantial amount of particulate metallic titanium, titanium oxide or sludge. Furthermore, the pores should be of a sufficiently small area to prevent a substantial quantity of the molten salt bath containing the titanium ions from passing into the anode compartment 14*a* from the cathode compartment 16*a*. Simultaneously, the openings are preferably of a size sufficient to permit passage of a sufficient amount of lithium chloride-potassium chloride electrolyte from the cathode compartment 16*a* to the anode compartment 14*a* to maintain a desired bath level in the anode compartment 14*a*. A metallic diaphragm with an electrolytically or electrolessly deposited coating layer of, preferably, cobalt on a preferred nickel substrate has been found to meet the above requirements. The plated diaphragm preferably has a $C_d$ of about 0.1 to about 0.5 and more preferably about 0.1 to about 0.4. when the $C_f$ is about 0.1 to about 25. Diaphragms with a lower $C_d$, for example 0.003, have, however, proven to be satisfactory for the production of titanium and are within the scope of this invention. The $C_f$ is preferably about 0.1 to about 8 and more preferably about 0.2 to about 1.

By the use of the described apparatus, and especially the porous diaphragm with predetermined $C_d$ and $C_f$, it has been found that a multivalent metal, such as titanium, can be produced without requiring adjustment of the diaphragm pore size during electrolysis. Furthermore, since the diaphragm preferably has a screenlike metal substrate with an adherent metal coating thereon, it can be readily stored prior to use and is more resistant to mechanical failure than are diaphragms containing ceramic materials.

Figure 3:
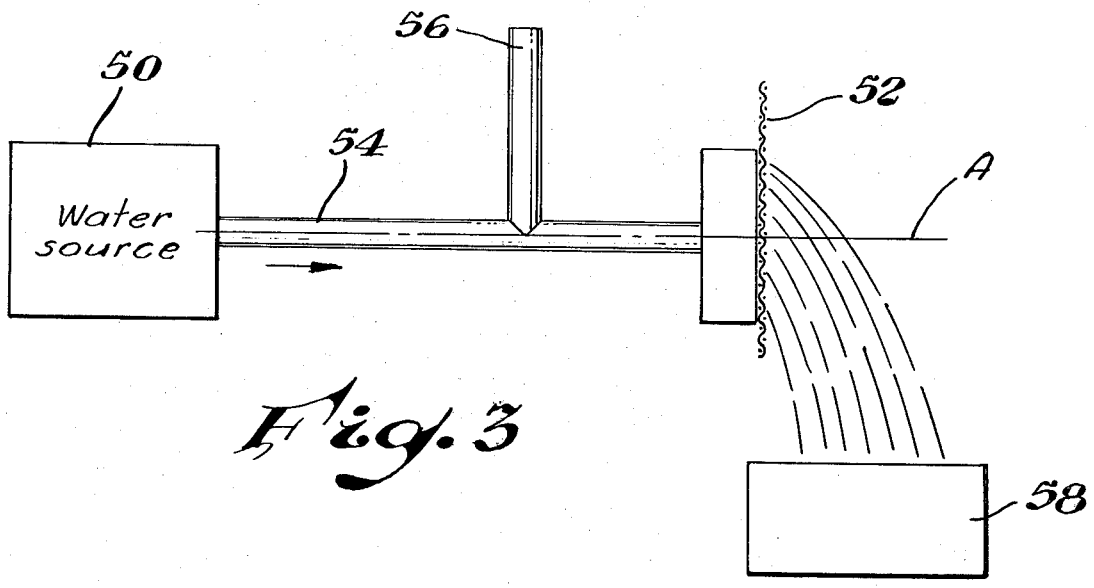
FIG. 3 is a schematic view of a means to measure the water flow rate through a diaphragm.

In FIG. 3 there is schematically depicted a means to measure the volumetric flow rate of water through a diaphragm. Water maintained at a temperature of about 75° C. is fed from a source 50 to a diaphragm 52 through a suitable conduit 54. The water flow rate is sufficient to maintain a water level, or head, in an upwardly extending conduit 56 at a distance of 10 inches from axis A of the conduit 54 to the upper surface of the water in the conduit 56. The upper end of the conduit 56 is open to the atmosphere. Maintaining such a head in conduit 56 insures that the average head over the diaphragm 52 tested is about 10 inches of water. The volume of water which flows through a 30 square inch portion of the diaphragm 52 is suitably measured in, for example, container 58. The measured flow rate in liters per minute is used to determine the flow coefficient, $C_f$.

Figure 4:
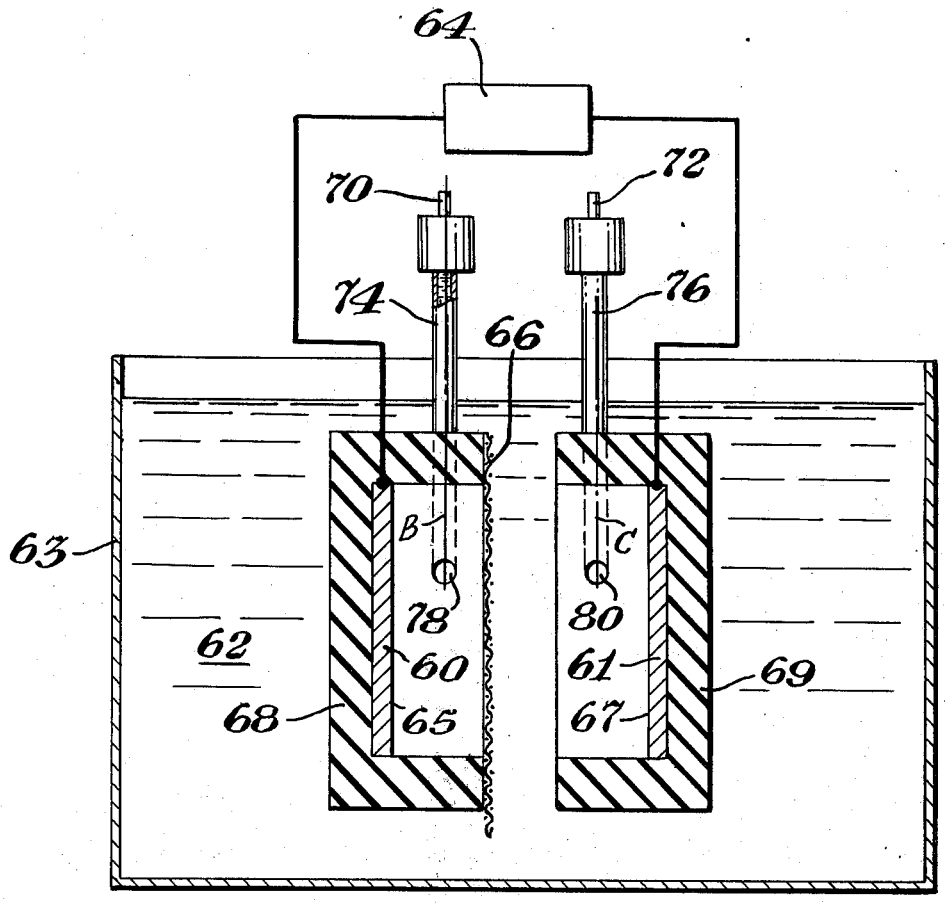
FIG. 4 is a schematic view of an apparatus suitable to measure the diaphragm coefficient.

Referring now to the test apparatus or cell of FIG. 4, $C_d$ is determined by immersing primary electrodes, such as, an anode 60 and a cathode 61, in an electrically conductive solution 62 within a container 63 and connecting such electrodes to a power source 64. Suitable conductive solutions are compatible with the electrodes 60 and 61 and a diaphragm 66 and have a sufficient electrical conductivity to afford an accurate determination of the electrical effect of insertion of the diaphragm 66 into the solution. The electrodes 60 and 61 and the conductive solution are selected to form a cell capable of a reversible electrolytic reaction. Also the conductivity of the solution is such that insertion of the diaphragm 66 into the solution between the electrodes 60 and 61 will produce an insufficient voltage change between such electrodes to cause the metallic diaphragm 66 to become a bipolar electrode. Silver-silver chloride electrodes have proven to be suitable for use as the electrodes 60 and 61 and are used herein in determining the $C_d$. Likewise, an aqueous 0.1 molar sodium chloride solution is suitable for the described $C_d$ determination and is used herein.

In practice, 1¼ inch by ½ inch by 1/16 inch thick silver-silver chloride electrodes 60 and 61 are suitably positioned within substantially electrically nonconductive retaining members 68 and 69 to space surface 65 of electrode 60 about 1 inch apart from surface 67 of electrode 61. The retaining members 68 and 69 can be constructed from, for example, a methyl acrylate plastic and adapted to direct substantially all of the electrical current passing between the electrodes 60 and 61 through the diaphragm 66 when such diaphragm is abuttingly detachably attached to the retaining members.

The voltage in the solution 62 is measured by using two auxiliary calomel measuring electrodes 70 and 72 connected to the retaining members 68 and 69 of the test cell by salt bridges 74 and 76. Orifices 78 and 80 of salt bridges 74 and 76, respectively, pass through the retaining members 68 and 69 at a position between the primary electrodes 60 and 61. The orifices 78 and 80 are suitably positioned to have a distance of ¾ inch between the centers of such orifices as represented by centerlines B and C.

The resistance of the solution 62 is determined by first impressing a sufficient voltage (direct current) between the primary electrodes 60 and 61 to produce a 0.002 ampere current flow between such primary electrodes. This voltage will be less than that voltage necessary to cause decomposition of the electrolyte solution 62. The voltage drop through the ¾ inch distance between the orifices 78 and 80 is measured by the calomel electrodes 70 and 72. The resistance of the solution is determined by dividing the measured voltage between the calomel electrodes 70 and 72 by 0.002 amperes.

The diaphragm 66 is placed in the solution 62 between the primary electrodes 60 and 61 and the salt bridge orifices 78 and 80 to thereby alter the electrical resistance between the electrodes. As aforementioned, the diaphragm 66 is placed in contact with the retaining member 68 in a manner suited to maximize the flow of current through the diaphragm and to minimize the passage of current through any openings at the interface between the surface of the retaining member 68 and the diaphragm 66.

The diaphragm 66 is positioned in the solution 62 between the primary electrodes 60 and 61 and the orifices 78 and 80 to the calomel electrodes 70 and 72 to thereby alter the electrical resistance between the calomel electrodes. At a uniform current of 0.002 amperes, the change in voltage between the calomel electrodes 70 and 72 resulting from insertion of the diaphragm in the test cell, is an amount representative of the porosity and surface characteristics or effectiveness of the diaphragm in the apparatus of the present invention.

The voltage change measured by the calomel electrodes after insertion of the diaphragm between the primary electrodes can readily be converted to an equivalent increase in inches of solution. The equivalent increase in inches of solution is herein referred to as the diaphragm coefficient.

The above-described test was used to determine the suitability of an about two inch diameter by about 5 inch long cylindrical nickel plated, woven nickel screen for use as an electrolytic cell diaphragm. The test apparatus contained a 0.1 molar sodium chloride aqueous electrolyte (reagent grade sodium chloride with a purity of about 99.5 weight percent dissolved in distilled water), two 1¼ inch by ½ inch by 1/16 inch thick rectangular silver-silver chloride primary electrodes spaced about one inch apart, and two standard calomel electrodes suitably physically connected between the primary electrodes by salt bridges to afford measurement of a voltage impressed across a ¾ inch distance of sodium chloride solution the silver-silver chloride electrodes were suitably mounted in an organic plastic frame adapted to permit insertion of the screen diaphragm between the electrodes. An electric potential was impressed across the primary electrodes and the voltage and direct current measured before and after positioning the screen diaphragm between the electrodes. Tests were carried out at a substantially constant temperature of 20° C. and atmospheric pressure. The voltage of the sodium chloride electrolyte was determined to be 60 millivolts and the current to be 2 milliamps before insertion of the diaphragm. The voltage increased to 75 millivolts after the diaphragm was inserted into the test cell; the current was maintained at 2 milliamps. The increase in voltage of 15 millivolts was calculated by standard methods to be equivalent to an increase in test cell resistance of 7.5 ohms or 0.188 inch of electrolyte.

As is apparent from the foregoing specification, the apparatus of the present invention is susceptible of being embodied with various alterations and modifications, which may differ from those described in the preceding description. For this reason, it is to be fully understood that all of the foregoing is intended to be illustrative and not to be construed or interpreted as being restrictive or otherwise limiting the present invention.

What is claimed is:

1. An electrolytic diaphragm cell, without means to adjust the diaphragm pore size, for the production of metallic titanium in a molten salt bath comprising:

a body adapted to contain the bath and to separate the bath from the ambient atmosphere;

an anode compartment disposed within said body;

a deposition cathode compartment disposed within said body and spaced apart from said anode compartment by a diaphragm;

at least one anode, adapted to be at least partially immersed in the bath, disposed within said anode compartment;

at least one deposition cathode, adapted to be at least partially immersed in the bath, disposed within said cathode compartment;

at least one foraminous diaphragm with a porous metal substrate and a metal coating thereon, the diaphragm being resistant to the corrosive environment within the containing means and having a diaphragm coefficient of greater than zero to about 0.5 and a flow coefficient within the range of from about 0.1 to about 25, the diaphragm being adapted to be at least partially immersed in the bath to space apart said anode and cathode compartments;

at least one feed means adapted to provide titanium ions to the bath;

a means to remove a gas from said anode compartment; and a means to provide sufficient electrical energy to said anode and said cathode to deposit solid titanium on said cathode.

2. The electrolytic cell of claim 1 wherein the diaphragm coefficient is within the range of from about 0.1 to about 0.5.

3. The electrolytic cell of claim 1 wherein the diaphragm coefficient is within the range of from about 0.1 to about 0.4.

4. The electrolytic cell of claim 1 wherein the flow coefficient is within the range of from about 0.1 to about 8.

5. The electrolytic cell of claim 4 wherein the diaphragm coefficient is within the range of from about 0.1 to about 0.4.

6. The electrolytic cell of claim 5 including a means to insulate said diaphragm from said anode, cathode, cell body and from electric sources outside of said cell.

7. The electrolytic cell of claim 5 wherein the metal coating is electrolytically deposited cobalt.

8. The electrolytic cell of claim 5 wherein the metal coating is electrolytically deposited nickel.

9. The electrolytic cell of claim 5 wherein the substrate is commercially pure nickel.

10. The electrolytic cell of claim 5 wherein the substrate consists essentially of cobalt or nickel.

11. The electrolytic cell of claim 10 wherein the metal coating is electrolessly deposited nickel.

12. The electrolytic cell of claim 10 wherein the metal coating is electrolessly deposited cobalt.

13. The electrolytic cell of claim 12 wherein the substrate is metal screen with a mesh of from about 50 to about 250.

14. The electrolytic cell of claim 13 wherein said diaphragm is electrically insulated from electric sources outside of said anode compartment and said cathode compartment.

15. The electrolytic cell of claim 5 wherein the coating consists essentially of cobalt or nickel.

16. The electrolytic cell of claim 1 wherein the flow coefficient is within the range of from about 0.2 to about 1.

17. The electrolytic cell of claim 16 wherein the diaphragm coefficient is within the range of from about 0.1 to about 0.4.

18. The electrolytic cell of claim 16 wherein the substrate is a metal screen with a mesh of from about 50 to about 250.

19. The electrolytic cell of claim 16 wherein the substrate consists essentially of cobalt or nickel.

20. The electrolytic cell of claim 16 wherein the metal coating is electrolytically deposited cobalt.

21. The electrolytic cell of claim 16 wherein the metal coating is electrolytically deposited nickel.

22. The electrolytic cell of claim 16 wherein the substrate is commercially pure nickel.

23. The electrolytic cell of claim 22 wherein the metal coating is electrolessly deposited nickel.

24. The electrolytic cell of claim 22 wherein the metal coating is electrolessly deposited cobalt.

25. The electrolytic cell of claim 24 wherein the substrate is a metal screen with a mesh of from about 50 to about 250.

26. The electrolytic cell of claim 25 wherein said diaphragm is electrically insulated from electric sources outside of said anode compartment and said cathode compartment.

27. The electrolytic cell of claim 1 wherein the substrate contains at least 50 weight percent of a metal selected from the group consisting of cobalt and nickel.

28. The electrolytic cell of claim 1 wherein the diaphragm substrate is commercially pure nickel.

29. The electrolytic cell of claim 1 wherein the metal coating is electrolytically deposited nickel.

30. The electrolytic cell of claim 1 wherein the metal coating is electrolessly deposited cobalt.

31. The electrolytic cell of claim 1 wherein the metal coating is electrolessly deposited nickel.

32. The electrolytic cell of claim 1 wherein the substrate is a metal screen with a mesh of from about 50 to about 250.

33. The electrolytic cell of claim 1 wherein the substrate is a metal screen with a mesh of from about 100 to about 200.

34. The electrolytic cell of claim 1 wherein the cell portion in contact with the electrolyte is resistant to molten salts and salt mixtures selected from the group consisting of NaCl, LiCl—KCl, LiCl—KCl—NaCl, and LiCl—KCl—$CaCl_2$.

35. The electrolytic cell of claim 1 wherein the cell portion in contact with the electrolyte is resistant to a mixture of lithium chloride and potassium chloride.

36. The electrolytic cell of claim 1 including a means to exclude oxygen, nitrogen, carbon dioxide and water vapor from within the cell.

37. The electrolytic cell of claim 1 wherein said electrical energy means is electrically connected to only the anode and the cathode.

38. The electrolytic cell of claim 37 including a means to electrically insulate said anode, cathode and diaphragm from said containing body.

39. The electrolytic cell of claim 1 including a means to electrically insulate said anode, cathode and diaphragm from said containing body.

40. The electrolytic cell of claim 1 wherein said electrical energy means is electrically connected to only said anode, cathode and feed means.

41. The electrolytic cell of claim 40 wherein said anode, cathode, feed means and diaphragm are electrically insulated from said containing body.

42. The electrolytic cell of claim 1 including a means to remove metallic titanium from said cathode compartment.

43. The electrolytic cell of claim 1 wherein said diaphragm is supported by a porous member to complement the physical strength of said diaphragm during operation of the electrolytic cell at elevated temperatures.

44. The electrolytic cell of claim 1 including a means to supply a protective gas into the said anode compartment and said cathode compartment.

45. The electrolytic cell of claim 1 wherein said feed means is adapted to regulatively supply titanium tetrachloride into said cathode compartment.

46. The electrolytic cell of claim 1 wherein the distance between said anode and said diaphragm is at least $\frac{1}{4}$ times the anode diameter.

47. The electrolytic cell of claim 1 wherein the distance between said anode and said diaphragm is within the range of from about $\frac{1}{4}$ to about $1\frac{1}{2}$ times the anode diameter.

48. The electrolytic cell of claim 1 wherein the distance between said anode and said diaphragm is substantially equal to the anode diameter.

49. The electrolytic cell of claim 1 wherein the coating consists essentially of cobalt.

50. The electrolytic cell of claim 1 wherein the coating consists essentially of nickel.

51. An electrolytic cell for the production of metallic titanium from titanium tetrachloride in a molten lithium chloride-potassium chloride salt bath comprising:

a body adapted to contain the bath and to separate the bath from the ambient atmosphere;

an anode compartment disposed within said body;

a deposition cathode compartment disposed within said body and spaced apart from said anode by a diaphragm;

at least one anode, adapted to be at least partially immersed in the bath, disposed within said anode compartment;

at least one deposition cathode, adapted to be at least partially immersed in the bath, disposed within said cathode compartment;

at least one woven metal diaphragm with a diaphragm coefficient with the range of from about 0.1 to about 0.5 and a flow coefficient within the range of from about 0.1 to about 25 adapted to be at least partially immersed in the bath to space apart said anode and said cathode compartments, said diaphragm consisting essentially of a nickel substrate screen with an adherent coating layer consisting essentially of cobalt or nickel;

at least one titanium tetrachloride feed means adapted to provide titanium ions to the bath;

a means to remove gaseous chlorine from said anode compartment; and a means to provide sufficient electrical energy to said anode and said cathode to deposit solid titanium on said cathode.

52. The electrolytic cell of claim 51 wherein the distance between said anode and said diaphragm is at least about ¼ times the anode diameter.

53. The electrolytic cell of claim 57 wherein the distance between said anode and said diaphragm is within the range of from about ¼ to about 1½ times the anode diameter.

54. The electrolytic cell of claim 51 wherein the distance between said anode and said diaphragm is substantially equal to the anode diameter.

55. The electrolytic cell of claim 51 wherein the diaphragm coefficient is within the range of from about 0.1 to about 0.5.

56. The electrolytic cell of claim 51 wherein the diaphragm coefficient is within the range of from about 0.1 to about 0.4.

57. The electrolytic cell of claim 51 wherein the flow coefficient is within the range of from about 0.1 to about 8.

58. The electrolytic cell of claim 57 wherein the diaphragm coefficient is within the range of from about 0.1 to about 0.4.

59. The electrolytic cell of claim 51 wherein the flow coefficient is within the range of from about 0.2 to about 1.

60. The electrolytic cell of claim 59 wherein the diaphragm coefficient is within the range of from about 0.1 to about 0.4.

61. The electrolytic cell of claim 51 wherein the substrate screen has a mesh within the range of from about 100 to about 200.

62. A metallic diaphragm suitable to separate an anode compartment from a cathode compartment in an electrolytic cell for electrolytically producing titanium comprising a foraminous member with a diaphragm coefficient of greater than zero to about 0.5 and a flow coefficient within the range of from about 0.1 to about 25, the surface of the foraminous member being coated with a metal consisting essentially of cobalt or nickel.

63. The diaphragm of claim 62 wherein said foraminous member consists essentially of an about 50 to about 250 mesh nickel substrate screen with an adherent coating layer consisting essentially of cobalt.

64. The diaphragm of claim 62 wherein the flow coefficient is within the range of from about 0.1 to about 8.

65. The diaphragm of claim 62 wherein the flow coefficient is within the range of from about 0.2 to about 1.

66. An electrolytic diaphragm cell, without means to adjust the diaphragm pore size, for the production of a multivalent metal in a molten salt bath comprising:

a body adapted to contain the bath, and to separate the bath from the ambient atmosphere;

an anode compartment disposed within said body;

a deposition cathode compartment disposed within said body and spaced apart from said anode compartment by a diaphragm;

at least one anode, adapted to be at least partially immersed in the bath, disposed within said anode compartment;

at least one deposition cathode, adapted to be at least partially immersed in the bath, disposed within said cathode compartment;

at least one foraminous diaphragm with a porous metal substrate and a metal coating thereon, the diaphragm being resistant to the corrosive environment within the containing means and having a diaphragm coefficient greater than zero to 0.5 and a flow coefficient within the range of from about 0.1 to about 25, the diaphragm being adapted to be at least partially immersed in the bath to space apart said anode and cathode compartments;

at least one feed means adapted to provide multivalent metal ions to the bath;

a means to remove a gas from said anode compartment; and a means to provide sufficient electrical energy to said anode and said cathode to deposit a solid multivalent metal on said cathode.

67. The electrolytic cell of claim 66 including a means to insulate said diaphragm from said anode, cathode, cell body and electric sources outside of said cell and said diaphragm has the specified diaphragm coefficient and flow coefficient at least before operation of the cell.

68. An electrolytic diaphragm cell, without means to adjust the diaphragm pore size, for the production of metallic titanium in a molten salt bath comprising:

a body adapted to contain the bath and to separate the bath from the ambient atmosphere;

an anode compartment disposed within said body;

a deposition cathode compartment disposed within said body and spaced apart from said anode compartment by a diaphragm;

at least one anode, adapted to be at least partially immersed in the bath, disposed within said anode compartment;

at least one deposition cathode, adapted to be at least partially immersed in the bath, disposed within said cathode compartment;

at least one feed means adapted to provide titanium ions to the bath;

a means to remove a gas from said anode compartment;

a means to provide sufficient electrical energy to said anode and said cathode to deposit solid titanium on said cathode;

at least one foraminous diaphragm with a porous metal substrate and a metal coating thereon, the diaphragm being resistant to the corrosive environment within the containing means and having a diaphragm coefficient greater than zero to about 0.5 and a flow coefficient within the range of from about 0.1 to about 25, the diaphragm being adapted to be at least partially immersed in the bath to space apart said anode and cathode compartments, the diaphragm coefficient being represented by the formula $$\frac{\frac{V_{d+s}}{I_{d+s}} - \frac{V_s}{I_s}}{\frac{V_s}{I_s}} \times 0.75$$

$V_s$ = voltage in volts in an aqueous 0.1 molar sodium chloride solution as determined by calomel measuring electrodes communicating with the solution by salt bridges with orifices to such salt bridges spaced 0.75 inch apart between silver-chloride primary electrodes spaced one inch apart $I_s$ = 0.002 amps $V_{d+s}$ = the voltage in volts as determined under the same conditions as for $V_s$ with the diaphragm positioned between the measuring electrodes $I_{d+s}$ = 0.002 amps, the flow coefficient is represented by the formula $$\sqrt{\frac{h}{F}}$$

where:

$h$ = a pressure head of ten inches of water at about 75° F. as measured upwardly from the centerline of a generally circular diaphragm portion, with a 30 square inch area on a single surface of the diaphragm portion, where a water flow measurement through the diaphragm is obtained, and $F$ = the volumetric water flow rate through the diaphragm portion at about 75° F. in liters per minute.

69. The cell of claim 68 wherein the diaphragm coefficient is from about 0.1 to about 0.5.

70. An electrolytic cell for the production of metallic titanium in a molten salt bath comprising:

a body adapted to contain the bath and to separate the bath from the ambient atmosphere;

an anode compartment disposed within said body;

a deposition cathode compartment disposed within said body and spaced apart from said anode compartment by a diaphragm;

at least one anode, adapted to be at least partially immersed in the bath, disposed within said anode compartment;

at least one deposition cathode, adapted to be be at least partially immersed in the bath, disposed within said cathode compartment;

at least one metallic, foraminous diaphragm, having a porous metal substrate with an electrolytically deposited cobalt coating thereon, resistant to the corrosive environment within the containing means with a diaphragm coefficient of greater than zero to about 0.5 and a flow coefficient within the range of from about 0.1 to about 25 adapted to be at least partially immersed in the bath to space apart said anode and cathode compartments;

at least one feed means adapted to provide titanium ions to the bath;

a means to remove a gas from said anode compartment; and a means to provide sufficient electrical energy to said anode and said cathode to deposit solid titanium on said cathode.

71. An electrolytic cell for the production of metallic titanium in a molten salt bath comprising:

a body adapted to contain the bath and to separate the bath from the ambient atmosphere;

an anode compartment disposed within said body;

a deposition cathode compartment disposed within said body and spaced apart from said anode compartment by a diaphragm;

at least one anode, adapted to be at least partially immersed in the bath, disposed within said anode compartment;

at least one deposition cathode, adapted to be at least partially immersed in the bath, disposed within said cathode compartment;

at least one metal coated, foraminous diaphragm resistant to the corrosive environment within the containing means with a diaphragm coefficient of greater than zero to about 0.5 and a flow coefficient within the range of from about 0.1 to about 25 adapted to be at least partially immersed in the bath to space apart said anode and cathode compartments, said diaphragm being electrically insulated from electric sources outside said anode and cathode compartments;

at least one feed means adapted to provide titanium ions to the bath;

a means to remove a gas from said anode compartment; and a means to provide sufficient electrical energy to said anode and said cathode to deposit solid titanium on said cathode.

72. The electrolytic cell of claim 71 wherein the coating consists essentially of cobalt.

73. The electrolytic cell of claim 72 wherein the diaphragm coefficient is within the range of from about 0.1 to about 0.4 and the flow coefficient is within the range of from about 0.1 to about 8.

74. The electrolytic cell of claim 71 wherein the coating consists essentially of nickel.

75. The electrolytic cell of claim 74 wherein the diaphragm coefficient is within the range of from about 0.1 to about 0.4 and the flow coefficient is within the range of from about 0.1 to about 8.

76. The electrolytic cell of claim 71 wherein the diaphragm coefficient is within the range of from about 0.1 to about 0.4 and the flow coefficient is within the range of from about 0.1 to about 8.

* * * * *

UNITED STATES PATENT AND TRADEMARK OFFICE

CERTIFICATE OF CORRECTION

PATENT NO. : 4,116,801

DATED : September 26, 1978

INVENTOR(S) : Paul R. Juckniess and David R. Johnson

It is certified that error appears in the above-identified patent and that said Letters Patent are hereby corrected as shown below:

Column 2, line 1, delete the word "no" and insert --to--.

Column 2, line 27, delete "wherein" and insert --where--.

Column 2, line 29, delete the word "cells" and insert --cell--.

Column 2, line 35, delete the word "the", first instance, and insert --that--.

Column 4, line 43, delete the word "procedure" and insert --procedures--.

Column 6, line 52, delete the comma "," after the word "substantially".

Column 7, line 18, delete the letter "s" before the figure "38", first instance.

Column 7, line 67, delete "merchanized" and insert --mechanized--.

UNITED STATES PATENT AND TRADEMARK OFFICE

CERTIFICATE OF CORRECTION

PATENT NO. : 4,116,801

DATED : September 26, 1978

INVENTOR(S) : Pau. R. Juckniess and David R. Johnson

It is certified that error appears in the above-identified patent and that said Letters Patent are hereby corrected as shown below:

Column 8, line 21, delete the period "." after "0.4".

Column 15, insert the word --where:-- after the first formula on lines 15-21.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*